United States Patent [19]

Toyoda

[11] Patent Number: 4,976,238

[45] Date of Patent: Dec. 11, 1990

[54] APPARATUS FOR CONTROLLING THE NUMBER OF IDLE ROTATIONS OF AN INTERNAL COMBUSTION ENGINE

[75] Inventor: Katsuhiko Toyoda, Shizuoka, Japan

[73] Assignee: Suzuki Jidosha Kogyo Kabushiki Kisha, Shizuoka, Japan

[21] Appl. No.: 477,618

[22] Filed: Feb. 9, 1990

[30] Foreign Application Priority Data

Feb. 21, 1989 [JP] Japan ..... 1-41438

[51] Int. Cl.[5] ..... F02M 3/45; F02M 3/00; F02D 41/16

[52] U.S. Cl. ..... 123/339; 123/585

[58] Field of Search ..... 123/339

[56] References Cited

U.S. PATENT DOCUMENTS

| | | | |
|---|---|---|---|
| 4,237,833 | 12/1980 | Des Lauriers | 123/339 |
| 4,344,399 | 8/1982 | Matsumura et al. | 123/339 |
| 4,402,289 | 9/1983 | Ikeura | 123/339 |
| 4,406,261 | 9/1983 | Ikeura | 123/339 |
| 4,406,262 | 9/1983 | Ikeura | 123/339 |
| 4,506,641 | 3/1985 | Hasegawa | 123/339 |

FOREIGN PATENT DOCUMENTS 63-215855 9/1988 Japan .

*Primary Examiner*—Tony M. Argenbright
*Assistant Examiner*—Robert E. Mates
*Attorney, Agent, or Firm*—Flynn, Thiel, Boutell & Tanis

[57] ABSTRACT

An apparatus controls the number of idle rotations of an internal combustion engine for a vehicle so that the number of engine revolutions becomes a target number of idle rotations, the apparatus starting the controlling of the number of idle rotations when each and every one of a plurality of first conditions is satisfied, the first conditions including the opening degree of an air inlet throttle valve of the internal combustion engine, the vehicle speed, and the number of engine revolutions. A control arrangement is provided for starting the controlling of the number of idle rotations so that the number of engine revolutions becomes a target number of idle rotations irrespective of the absence of satisfaction of each of the first conditions, the control arrangement starting the controlling of the number of idle rotations in response to satisfaction of each of the following second conditions: the opening degree of the air inlet throttle valve is an idle opening degree, and the number of engine revolutions drops below a value slightly above the target number of idle rotations after the controlling of the number of idle rotations stops due to the absence of satisfaction of one of the first conditions.

3 Claims, 3 Drawing Sheets

FIG. 4
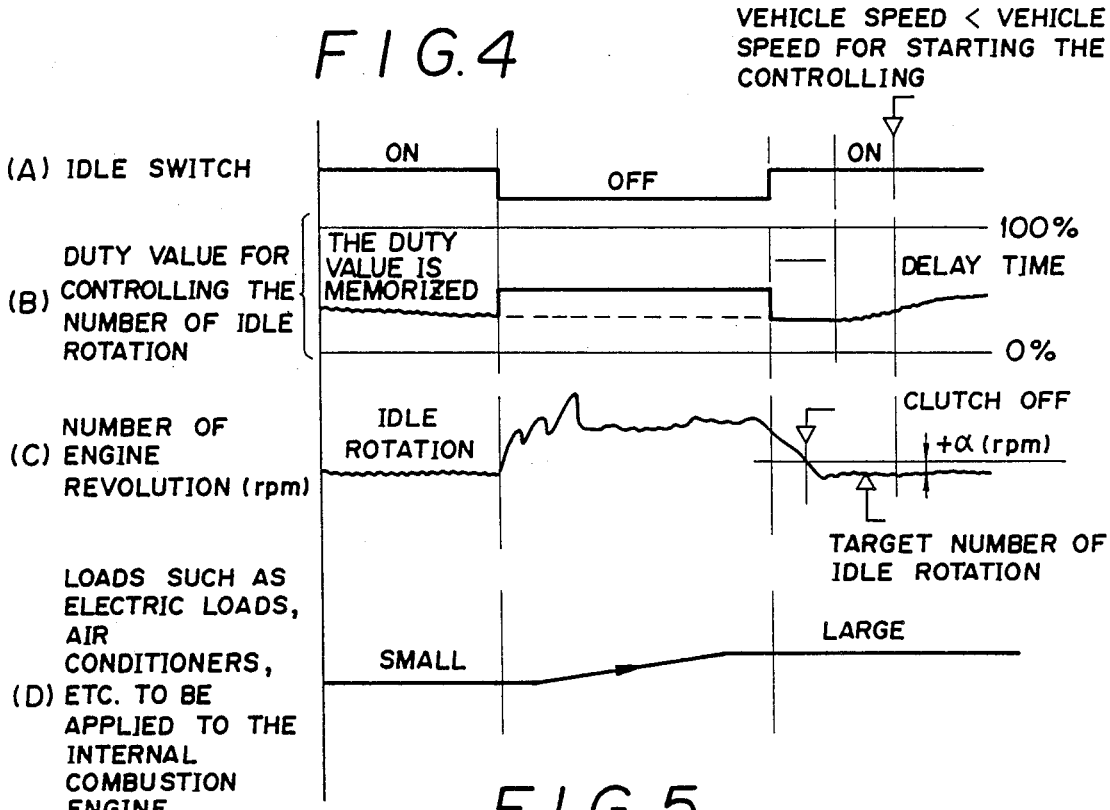
FIG. 5
PRIOR ART
| COOLING WATER TEMPERATURE (°C) | -30 | -20 | -10 | 0 | 10 | ---- |
|---|---|---|---|---|---|---|
| TARGET NUMBER OF IDLE ROTATION (rpm) | 2000 | 1800 | 1600 | 1400 | 1200 | ---- |
FIG. 6
PRIOR ART
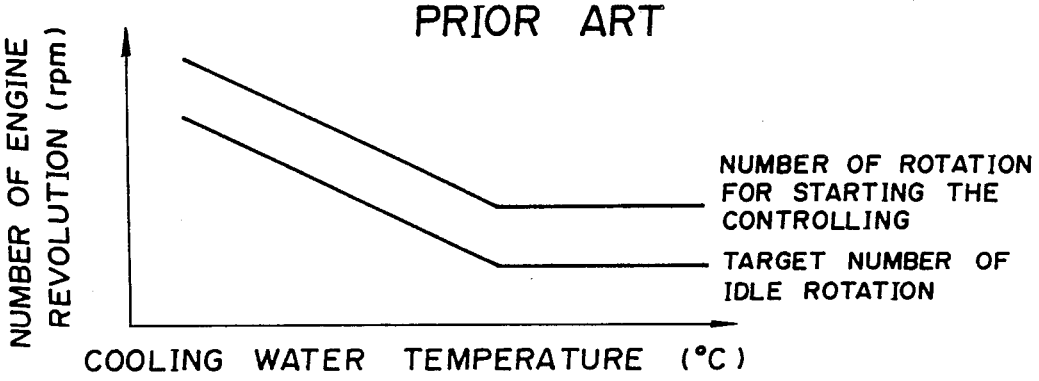

APPARATUS FOR CONTROLLING THE NUMBER OF IDLE ROTATIONS OF AN INTERNAL COMBUSTION ENGINE

FIELD OF THE INVENTION

This invention relates to an apparatus for controlling the number of idle rotations of an internal combustion engine and, more particularly, to such an apparatus which is capable of preventing an excessive decrease in the number of engine revolutions causing engine stall and the like, which can occur if controlling of the number of engine revolutions is started after controlling of the idle rotations stops.

BACKGROUND OF THE INVENTION

Among internal combustion engines, there are some which include an apparatus for controlling the number of idle rotations. The apparatus for controlling the number of idle rotations includes a bypass air inlet passage for providing communication between points in an air inlet passage which are on opposite sides of an air inlet throttle valve of the internal combustion engine so as to bypass the throttle valve, and a control valve for controlling the quantity of air passing through the bypass passage, the bypass air inlet quantity control valve being actuated by a duty ratio signal in order to control the number of idle rotations through feed-back so that the number of engine revolutions becomes a target number of idle rotations. The apparatus for controlling the number of idle rotations of the internal combustion engine, as shown in FIGS. 5 and 6, controls the number of idle rotations to a target number less than the number of rotations for starting the controlling of the idle rotations so that the number of engine revolutions becomes the target number of idle rotations, which target number is set in accord with the temperature of the cooling water. Also, the apparatus for controlling the number of idle rotations, as shown in FIGS. 7 and 8, starts the controlling of the number of idle rotations so that the number of engine revolutions becomes the target number of idle rotations when each and every one of certain conditions for starting the controlling of the number of idle rotations is satisfied, the conditions relating to the opening degree of an air inlet throttle valve of the internal combustion engine, the vehicle speed, and the number of engine revolutions.

More specifically, the apparatus for controlling the number of idle rotations starts controlling the number of idle rotations so that the number of engine rotations becomes the target number of idle rotations if each and every one of the following conditions is satisfied: the idle switch has been turned on to indicate that the opening degree of the air inlet throttle valve is the idle opening degree and a delay time has passed (idle switch ON+delay time); the vehicle speed detected by a vehicle speed sensor is less than the vehicle speed for starting the controlling of the number of idle rotations (vehicle speed<vehicle speed for staring the idle controlling); and the number of engine revolutions detected by an engine speed sensor is less than the number of rotations for starting the idle controlling (number of engine revolutions<number of rotations for starting the idle controlling). In addition, the apparatus for controlling the number of idle rotations also starts the controlling of the number of idle rotations so that the number of engine rotations becomes the target number of idle rotations if each and every one of the following conditions is satisfied: the idle switch is turned on to indicate that the opening degree of the air inlet throttle valve is the idle opening degree (idle switch ON); the number of engine revolutions is less than the target number of idle rotations (number of engine revolutions<target number of idle rotations); the vehicle speed detected by a vehicle speed sensor is less than the vehicle speed for starting the controlling of the number of idle rotations (vehicle speed<vehicle speed for starting the idle controlling); and the number of engine revolutions detected by an engine speed sensor is less than the number of rotations for starting the idle controlling (number of engine revolutions<number of rotations for starting the idle controlling).

Also, when the controlling of the number of idle rotations is subsequently stopped because one of the conditions for starting the controlling of the number of idle rotations is no longer satisfied, for example where the vehicle speed becomes equal to or greater than the vehicle speed for starting the idle controlling, the duty ratio of the signal controlling the bypass air inlet quantity control valve is maintained at a fixed value. There are two approaches for maintaining the duty ratio at a fixed value. In one case, the duty ratio is maintained at a preset fixed value, whereas in the other case a duty ratio being used to control the number of idle revolutions just before the controlling of the number of idle rotations is stopped is memorized and the duty ratio is thereafter maintained at the memorized value.

As such an apparatus for controlling the number of idle rotations, there is that disclosed in Japanese Patent Early Laid-Open Publication No. Sho 63-215855. The apparatus disclosed in this Publication is intended to prevent an increase in the number of idle rotations under a no load driving condition when it is shifted from a state where the bypass air inlet quantity is large to a state where the quantity is small, and to rapidly stabilize it at a predetermined number of idle rotations.

In a case where the opening degree of the air inlet throttle valve becomes the idle opening degree as a result of turning on of the idle switch, as in a case where the vehicle is running at a reduced speed and the clutch is separated to bring the clutch switch to its off position so that the vehicle speed detected by the vehicle speed sensor is at or above the speed level below which starting of the idle controlling occurs, the variable controlling of the bypass air inlet quantity control valve, as mentioned above, is stopped and the duty ratio of the signal controlling the bypass air inlet quantity control valve is maintained at a fixed value and the number of engine revolutions (engine speed) is decreased toward the target number of idle rotations.

At this time, however, owing to the application to the engine of loads such as electric loads and air conditioning equipment as an auxiliary device, if the quantity of bypass air passing through the bypass air inlet quantity control valve (determined by the duty ratio set to the fixed value) is less than the required bypass air inlet value, the number of engine rotations is excessively decreased to a value below the target number of idle rotations, thus sometimes resulting in engine stall. Also, if the bypass air quantity passing through the bypass air inlet quantity control valve (determined by the duty ratio set to the fixed value) is larger than the required bypass air inlet quantity, the number of engine revolutions does not decrease all the way to the target number of idle rotations, and to the contrary may sometimes increase.

In this case, there may be additionally provided a load switch for detecting the application of electric loads and the like, so that the controlling of the number of idle rotations is started when an additional condition is satisfied, namely that the load becomes greater than a load above which starting of idle controlling is permitted. However, there is a disadvantage in this arrangement, in that a cost increase is involved owing to the additional employment of a load switch.

Therefore, an object of the present invention is to provide an apparatus for controlling the number of idle rotations of an internal combustion engine which is capable of preventing an excessive decrease of the number of engine rotations, engine stall and the like occurring when the controlling of the number of rotations is started after controlling of the number of idle rotations is stopped, and in which a cost increase due to the additional provision of a load switch is avoided.

SUMMARY OF THE INVENTION

This object is achieved by providing an apparatus for controlling the number of idle rotations of an internal combustion engine for a vehicle so that the number of engine revolutions becomes a target number of idle rotations, the apparatus starting the controlling of the number of idle rotations when each and every one of a plurality of first conditions is satisfied, the first conditions depending on the opening degree of an air inlet throttle valve of the internal combustion engine, the vehicle speed, and the number of engine revolutions. A control arrangement is provided for starting the controlling of the number of idle rotations so that the number of engine revolutions becomes a target number of idle rotations irrespective of the absence of satisfaction of each of the first conditions, the control arrangement starting the controlling of the number of idle rotations in response to satisfaction of each of the following second conditions: the opening degree of the air inlet throttle valve is an idle opening degree, and the number of engine revolutions drops below a value slightly above the target number of idle rotations after the controlling of the number of idle rotations stops due to the absence of satisfaction of one of the first conditions.

According to the construction of the present invention, by virtue of the provision of the control arrangement, the controlling of the number of idle rotations is started so that the number of engine revolutions becomes the target number of idle rotations irrespective of the absence of satisfaction of each of the first conditions, the control arrangement starting the controlling of the number of idle rotations in response to satisfaction of the second conditions: the opening degree of the air inlet throttle valve being the idle opening degree, and the number of engine revolutions dropping below a value slightly above the target number of idle rotations after the controlling of the number of idle rotations stops due to the absence of satisfaction of one of the first conditions.

BRIEF DESCRIPTION OF THE DRAWINGS

A preferred embodiment of the present invention will be described in detail with reference to the drawings, in which:

FIGS. 1 through 4 show a preferred embodiment of the present invention, FIG. 1 being a diagrammatic view of an apparatus for controlling the number of idle rotations of an internal combustion engine, FIG. 2 being a diagram of a logic circuit which is part of the apparatus of FIG. 1 and determines conditions for starting controlling of the number of idle rotations, FIG. 3 being a diagram of a logic circuit which is part of the apparatus of FIG. 1 and determines conditions memorizing duty ratio, and FIGS. 4 (A–D) being timing diagrams for the apparatus of FIG. 1 showing signals relating to an idle switch, a duty ratio, an engine speed, and a load; and FIGS. 5 through 8 relate to a prior art arrangement, FIG. 5 being a table showing a relation between a cooling water temperature and a target number of idle rotations, FIG. 6 being a graph showing a relation between the target number of idle rotations and a number of rotations for starting idle control with respect to the cooling water temperature, FIG. 7 being a diagram of a logic circuit which determines conditions for starting the controlling of the number of idle rotations, and FIGS. 8 (A–D) being timing diagrams showing signals relating to an idle switch, a duty ratio, a number of engine revolutions, and collective loads.

DETAILED DESCRIPTION

Figure 1:
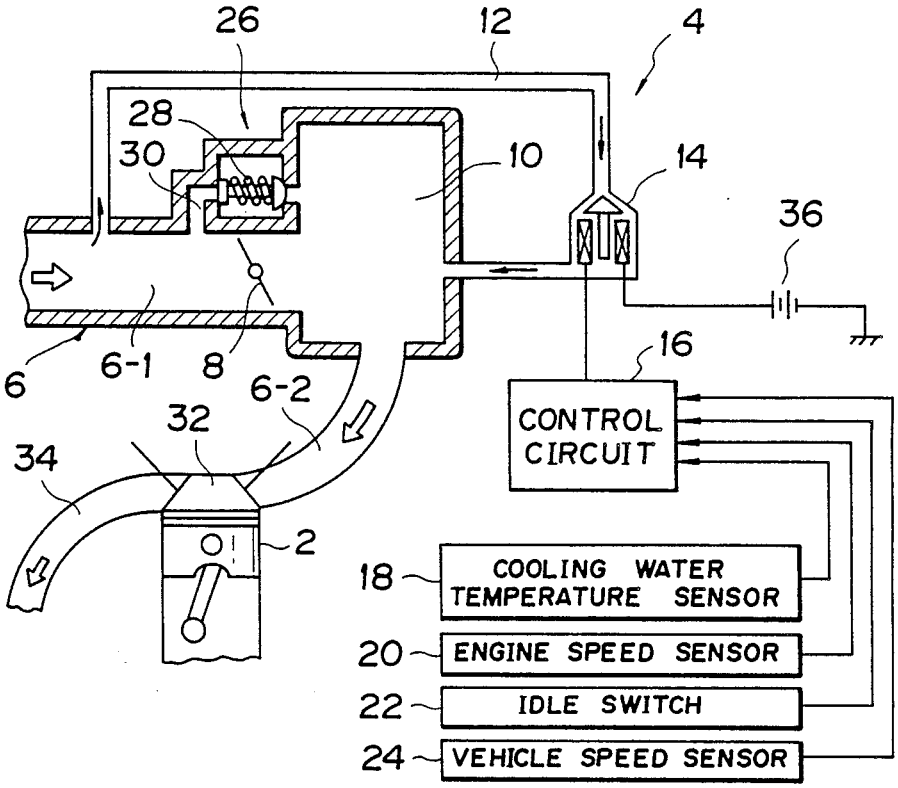

FIGS. 1 through 4 show a preferred embodiment of the present invention. An idle rotation number control apparatus 4 is provided with a bypass air inlet passage 12 adapted to provide communication between an upstream side 6-1 of an air inlet passage 6 and a surge tank 10 of a downstream side air inlet passage 6-2 in such a manner as to bypass an air inlet throttle valve 8 disposed in the air inlet passage 6 of an internal combustion engine 2. This bypass air inlet passage 12 is provided with a bypass air inlet quantity control valve 14 which is activated by a duty ratio signal, the quantity of air passing through the valve increasing progressively as the duty ratio of the control signal progressively increases. By means of this bypass air inlet quantity control valve 14, the quantity of air passing through the bypass air inlet passage 12 is regulated and the number of idle rotations is controlled by means of a feedback operation determining the duty ratio so that the actual number of engine rotations becomes a target number of idle rotations.

This bypass air inlet quantity control valve 14 is controlled by a control circuit 16. The control circuit 16 receives signals from: a temperature sensor 18 detecting the temperature of cooling water of the internal combustion engine 2, an engine speed sensor 20 for detecting the number of engine revolutions, an idle switch 22 which is turned on when the opening degree of the air inlet throttle valve 8 is an idle opening degree and is turned off when the opening degree of the valve 8 is more than the idle opening degree, and a vehicle speed sensor 24 for detecting the vehicle speed. By virtue of the foregoing arrangement, the idle rotation number control apparatus 4 controls the number of idle rotations so that the number of engine rotations becomes a target number of idle rotations set in accord with the temperature of the cooling water when the engine speed is less than the set number of rotations for starting the idle controlling.

This idle rotation number control apparatus 4 starts the controlling of the number of idle rotations (so that the number of engine revolutions becomes the target number of idle rotations) when each and every one of certain conditions for starting the controlling of the number of idle rotation is satisfied, the conditions depending on the opening degree of the air inlet throttle valve 8 indicated by the idle switch 22, the vehicle speed detected by the vehicle speed detecting sensor 24, and the number of engine revolutions detected by the engine speed sensor 20.

Figure 2:
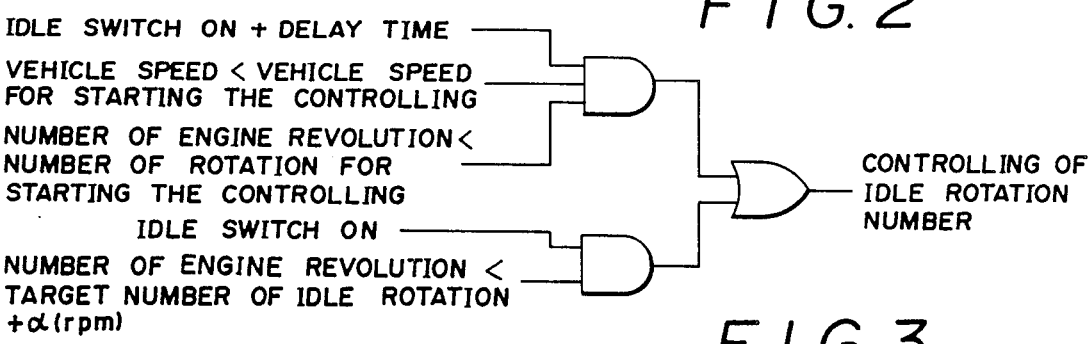

More specifically, the control circuit 16, as shown in FIG. 2, starts controlling the number of idle rotations so that the number of engine rotations becomes the target number of idle rotations if each and every one of the following conditions is satisfied: the idle switch 22 has turned on to indicate that the opening degree of the air inlet throttle valve 8 is the idle opening degree and has remained on while a delay time passed (idle switch ON+delay time); the vehicle speed detected by vehicle speed sensor 24 is less than a vehicle speed below which starting of the controlling of the number of idle rotations is permitted (vehicle speed <vehicle speed for starting the idle controlling); and the number of engine revolutions detected by the engine speed sensor 20 is less than a number of rotations below which starting of the idle controlling is permitted (number of engine revolutions<number of rotations for starting the idle controlling).

Furthermore, the control circuit 16, as shown in FIG. 2, starts the controlling of the number of idle rotations (so that the number of engine rotations becomes the target number of idle rotations) irrespective of a failure to satisfy each and every one of the conditions just mentioned, if instead each and every one of the following conditions are satisfied: the opening degree of the air inlet throttle valve 8 is the idle opening degree and thus the idle switch is ON; and the number of engine revolutions drops below a value slightly above the target number of idle rotations mentioned above (number of engine revolutions<target number of idle rotations+$\alpha$).

When the controlling of the number of idle rotations is stopped due to failure to satisfy one of the conditions for starting the controlling of the number of idle rotations, for example because the actual vehicle speed becomes equal to or greater than the vehicle speed value for starting the idle controlling, the duty ratio of the signal controlling the bypass air inlet quantity control valve 14 is maintained at a fixed value. There are two approaches for maintaining the duty ratio at a fixed value. In one case, the duty ratio is maintained at a preset fixed value, and in the other case a duty ratio being used to control the number of idle revolutions just before controlling of the number of idle rotations is stopped is memorized and the duty ratio is thereafter maintained at the memorized value.

In FIG. 1, reference numeral 26 denotes an air regulator. The air regulator 26 controls the opening and closing of an air passage 30 disposed in such a manner as to bypass the air inlet throttle valve 8 in accord with the temperature of the cooling water, to correct the air quantity supplied into the downstream side air inlet passage 6-2 when the water temperature is low, the regulator 26 having an air valve 28 which is activated by utilizing the displacement of a temperature sensitive displacement body such as thermo-wax or the like.

Next, the operation of the preferred embodiment will be described with reference to FIG. 4.

The idle rotating number control apparatus 4, through the control circuit 16, starts controlling the number of idle rotations during the driving time of the internal combustion engine 2 when each and every one of the following conditions is satisfied: the idle switch 22 has turned on to indicate the opening degree of the air inlet throttle valve 8 is the idle opening degree and a delay time has passed (idle switch ON+delay time); the vehicle speed detected by vehicle speed sensor 24 is less than the vehicle speed below which starting of the controlling of the number of idle rotations is permitted (vehicle speed<vehicle speed for starting the idle controlling); and the number of engine revolutions detected by the engine speed sensor 20 is less than the number of rotations below which starting of the idle controlling is permitted (number of engine revolutions<number of rotations for starting the idle controlling).

Figure 3:
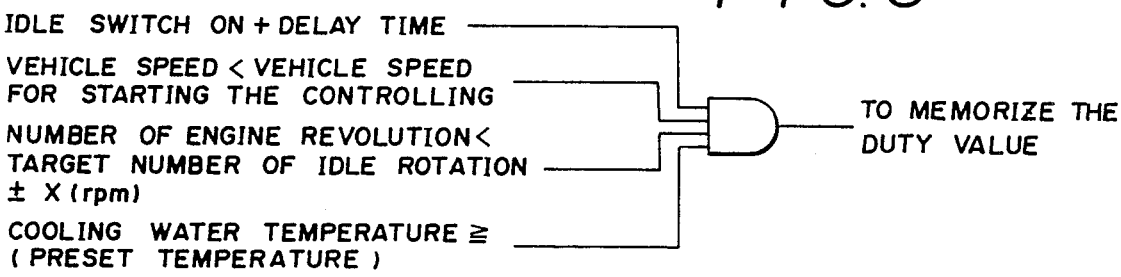
Figure 7:
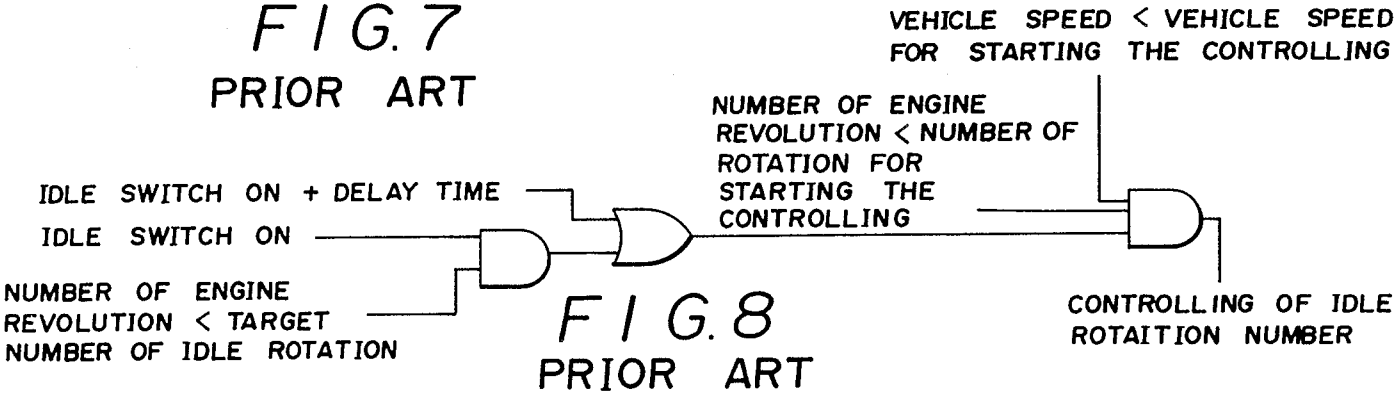
FIG. 7 PRIOR ART
Figure 8:
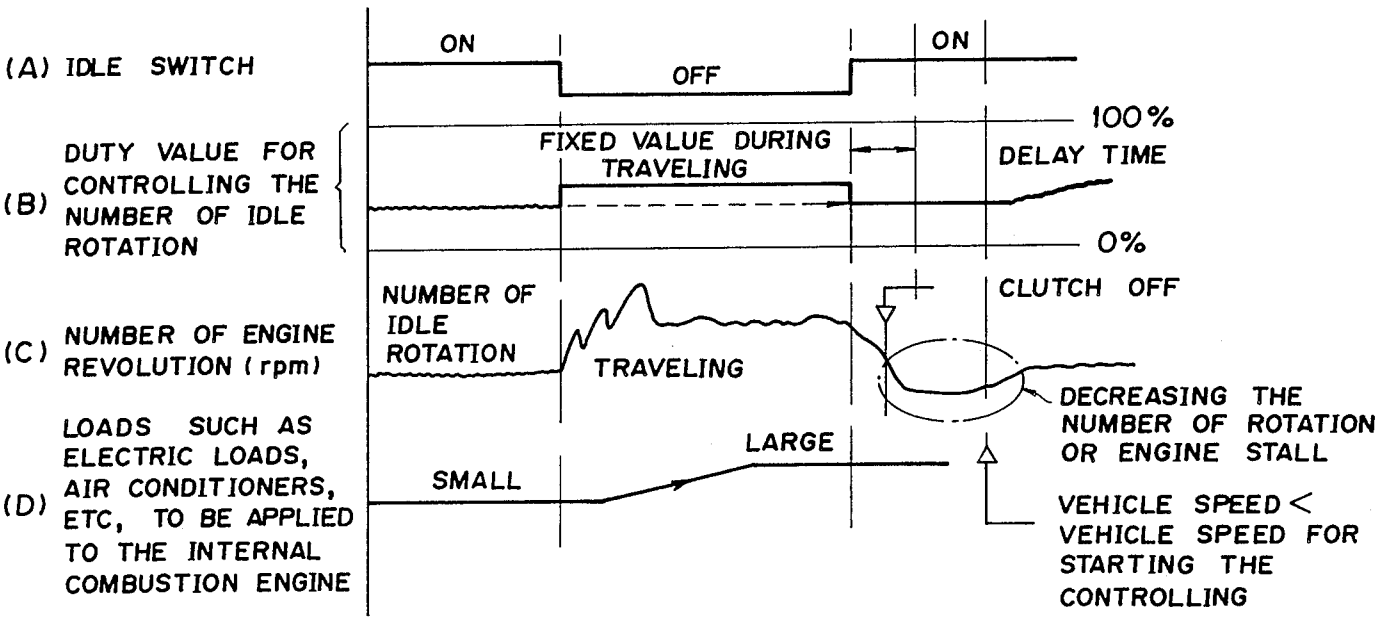
FIG. 8 PRIOR ART

When the controlling of the number of idle rotations is stopped because of a failure to satisfy one of the conditions for starting the controlling of the number of idle rotations, such as for example the vehicle speed becoming more than the vehicle speed for starting the controlling, the duty ratio signal controlling the bypass air inlet quantity control valve 14 is maintained at a fixed value. At this time, the duty ratio used for controlling the number of idle rotations just before controlling of the number of idle rotations is stopped is memorized, such stored value being memorized and maintained as shown in FIG. 3.

That is, the idle rotating number control apparatus 4 continuously memorizes a duty ratio being used to control the number of idle rotations when each and every one of the following conditions are satisfied: the idle switch 22 has turned on to indicate the opening degree of the air inlet throttle valve 8 is the idle opening degree and a delay time has passed (idle switch ON+delay time); the vehicle speed detected by the vehicle speed sensor 24 is less than the vehicle speed for starting the idle controlling (vehicle speed<vehicle speed for starting the idle controlling); the engine speed detected by the engine speed sensor 20 is within a predetermined range bounded by preset rotation values which are respectively set above and below the target number of idle rotations (number of engine rotations=target number of idle rotations±x); and the temperature of the cooling water detected by the temperature sensor 18 is at or above a preset temperature (cooling water temperature≧preset temperature). When the controlling of the number of idle rotations is stopped, the continuous memorizing stops and the last memorized value is maintained and thereafter used as the fixed duty ratio for the signal controlling the bypass inlet air quantity control valve 14.

When, as at the speed reduced time, the idle switch 22 is turned on to indicate that the opening degree of the air inlet throttle valve 8 is the idle opening degree and the clutch (not shown) is disengaged to turn the clutch switch on so that, as a result, the vehicle speed detected by the vehicle speed sensor 20 is more than the vehicle speed for starting the idle controlling, the controlling of the number of idle rotations is stopped and the duty ratio of the signal controlling the bypass air inlet quantity control valve 14 is maintained at the fixed value and the number of engine revolutions is decreased toward the target number of idle rotations as mentioned previously.

At this time, however, because of the application of loads such as electric loads, air conditioning equipment as an auxiliary device, and the like, if the air quantity passing through the bypass air inlet quantity control valve 14 (determined by the duty ratio set to the fixed value) is smaller than the required air quantity, the number of engine rotations may be excessively decreased to a point below the target number of idle rotations, thus resulting in engine stall. Also, if the air quantity passing through the bypass air inlet quantity control valve 14 (determined by the duty ratio set to the fixed value) is larger than the required air quantity, the number of engine revolutions may not decrease to the target number of idle rotations and, to the contrary, may increase.

In this case, although it is known to start the controlling of the number of idle rotations by additionally employing a load switch adapted to detect loads such as electric loads and the like, and an additional condition determining that the load is more than a load for starting the idle controlling, there is a disadvantage in that the additional employment of the load switch invites a cost increase.

Therefore, in such a case, according to the invention the control circuit 16 starts the controlling of the number of idle rotations so that the number of engine revolutions becomes the target number of idle rotations when each and every one of the following conditions are satisfied: the opening degree of the air inlet throttle valve 8 is the idle opening degree (the idle switch is ON); and the number of engine revolutions drops below a value slightly above the target number of idle rotations (number of engine revolutions $<$ target number of idle rotations $+\alpha$).

By virtue of the foregoing arrangement, the starting time for controlling the number of idle rotations can be advanced without employing additional hardware such as a load switch for detecting loads such as electric loads and the like.

Accordingly, by advancing the starting time for controlling the number of idle rotations, there can be avoided a disadvantage where the number of engine rotations is excessively decreased to a value below the target number of idle rotations, thus resulting in engine stall. Also, by virtue of the provision of an additional condition determining whether the load is more than a load above which starting the idle controlling is permitted, there can be avoided the additional provision of a load switch for detecting loads such as electric loads and the like. As a result, a cost increase is not invited, either.

As described above, according to the present invention, the controlling of the number of idle rotations is started so that the number of engine revolutions becomes the target number of idle rotations when each and every one of the following conditions is satisfied: the opening degree of the air inlet throttle valve of the internal combustion engine is the idle opening degree; and the number of engine revolutions drops below a value slightly above the target number of idle rotations. Accordingly, there is no longer a need for additional hardware such as a load switch for detecting loads such as electric loads and the like, and the starting time for controlling the idle rotations can be advanced.

As a consequence, by advancing the starting time for controlling the number of idle rotations, there can be prevented the disadvantage that the engine speed is excessively decreased to a value below the target number of idle rotations, thus resulting in engine stall. Also, as the controlling of the number of idle rotations is started by providing an additional condition determining that the load is more than a load above which starting of the idle controlling is permitted, there is no longer any need for an additional load switch for detecting loads such as electric loads and the like. As a result, a cost increase is not invited either.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an apparatus for controlling the number of idle rotations of an internal combustion engine for a vehicle so that the number of engine revolutions becomes a target number of idle rotations, said apparatus starting the controlling of the number of idle rotations when each and every one of a plurality of first conditions is satisfied, said first conditions including the opening degree of an air inlet throttle valve of the internal combustion engine, the vehicle speed, and the number of engine revolutions, the improvement comprising control means for starting the controlling of the number of idle rotations so that the number of engine revolutions becomes the target number of idle rotations irrespective of the absence of satisfaction of each of the first conditions, said control means starting controlling of the number of idle rotations in response to satisfaction of each of the following second conditions: the opening degree of said air inlet throttle valve is an idle opening degree, and the number of engine revolutions drops below a value slightly above the target number of idle rotations after the controlling of the number of idle rotations stops due to the absence of satisfaction of one of said first conditions.

2. An apparatus, comprising: an internal combustion engine having an intake passage; a throttle valve which is disposed in said intake passage and controls air flow therethrough, said throttle valve being movable to an idle position; a bypass passage communicating with said intake passage on opposite sides of said throttle valve; a control valve which is disposed in said bypass passage and controls air flow therethrough; an engine speed sensor; and control means for controlling said control valve in a first mode in which said control valve progressively varies air flow through said bypass passage as a function of a signal from said engine speed sensor to effect feedback control of the engine speed toward a target speed, and in a second mode in which said control valve effects a substantially constant air flow through said bypass passage, said control means including means for causing said control means to implement said first mode when said throttle valve is in said idle position and the engine speed sensed by said engine speed sensor is below a speed value which is greater than said target speed.

3. An apparatus as recited in claim 2, wherein said speed value is determined by adding a constant value to said target speed.

* * * * *

UNITED STATES PATENT AND TRADEMARK OFFICE

CERTIFICATE OF CORRECTION

PATENT NO. : 4 976 238

DATED : December 11, 1990

INVENTOR(S) : Katsuhiko Toyoda

It is certified that error appears in the above-identified patent and that said Letters Patent is hereby corrected as shown below:

On the title page, item (73) change the assignee's name from "Suzuki Jidosha Kogyo Kabushiki Kisha" to ---Suzuki Jidosha Kogyo Kabushiki Kaisha---.

Signed and Sealed this

First Day of September, 1992

*Attest:*

DOUGLAS B. COMER

*Attesting Officer*

*Acting Commissioner of Patents and Trademarks*